US005147046A

United States Patent [19]

Hata et al.

[11] Patent Number: 5,147,046

[45] Date of Patent: Sep. 15, 1992

[54] GRAVITY SEPARATION METHOD USING IRON POWDER

[75] Inventors: Masamichi Hata; Manabu Futamata, both of Kitakyushu, Japan

[73] Assignee: Kyusyumetal Industry Co., Ltd., Kitakyushu, Japan

[21] Appl. No.: 559,307

[22] Filed: Jul. 30, 1990

Related U.S. Application Data

[63] Continuation-in-part of Ser. No. 492,207, Mar. 12, 1990, abandoned, which is a continuation of Ser. No. 255,654, Oct. 7, 1988, abandoned.

[30] Foreign Application Priority Data

Apr. 15, 1988 [JP] Japan ..... 63-92844

[51] Int. Cl.[5] ..... B03B 5/30

[52] U.S. Cl. ..... 209/172.5; 252/60

[58] Field of Search ..... 209/172.5; 252/60

[56] References Cited

U.S. PATENT DOCUMENTS

| | | | |
|---|---|---|---|
| 2,203,601 | 6/1940 | Rakowsky | 209/172.5 |
| 2,206,574 | 7/1940 | Pearson | 209/172.5 |
| 2,942,792 | 6/1960 | Anderson | 209/172.5 |
| 3,021,288 | 2/1962 | Jappa | 209/172.5 |
| 3,454,498 | 7/1969 | Gabler | 209/172.5 |
| 3,943,061 | 3/1976 | Cziska | 209/172.5 |
| 4,319,988 | 3/1982 | Aldrich | 209/172.5 |
| 4,347,124 | 8/1982 | Shimoiizaka | 209/172.5 |
| 4,432,868 | 2/1984 | Aldrich | 209/172.5 |

*Primary Examiner*—Stanley Silverman
*Assistant Examiner*—Thomas M. Lithgow
*Attorney, Agent, or Firm*—Ladas & Parry

[57] ABSTRACT

A gravity separation method using iron powder is employed for subjecting a metal or ore to sink-float separation using a specific gravity liquid in which the iron powder is mixed and suspended. This gravity separation method comprises mixing and suspending the iron powder composed of fine particles having a size of 40 microns or less to form a specific gravity liquid having specific gravity within the range of 2.6 to 3.5, depending upon the intended use, and pouring various raw materials such as metals and ores into the specific gravity liquid so as to subject the raw materials to sink-float separation.

1 Claim, 2 Drawing Sheets

GRAVITY SEPARATION METHOD USING IRON POWDER

This is a continuation-in-part of copending application Ser. No. 07/492,207 filed on Mar. 12, 1990, (now abandoned) which is a continuation application of Ser. No.: 07/255,654 filed on Oct. 7, 1988 (now abandoned).

FIELD OF THE INVENTION

The present invention relates to a gravity separation method using iron powder for performing sink-float separation of metals, ores and the like by using a specific gravity liquid in which iron powder is mixed and suspended.

DESCRIPTION OF THE PRIOR ART

In conventional methods of separating various raw materials by using a given specific gravity, the chemicals described below are generally used in laboratories.

| Reagents | Molecular Formula | Maximum Specific Gravity | Viscosity (20° C.) |
|---|---|---|---|
| Zinc chloride | $ZnCl_2$ | 1.95 | |
| Carbon tetrachloride | $CCl_4$ | 1.60 | 0.98 |
| Benzene | $C_6H_6$ | 0.88 | 0.65 |
| Toluene | $C_7H_8$ | 0.88 | 0.59 |
| Bromoform | $CHBr_3$ | 2.90 | |
| Tetrabromoethane | $C_2H_2Br_4$ | 2.96 | |
| Methyl iodide | $CH_3I$ | 2.29 | 0.50 |
| Acetylene tetrabromide | $(CHBr_2)$ | 2.96 | |

However, all these chemicals are expensive, and some of them have high degrees of toxicity and are thus not usable by industry.

Gravity separation methods have been industrially used in which suspensions of fine particles of solids in water, listed below, which are relatively inexpensive, easily available and have substantially no toxicity are formed. These are adjusted to have a given specific gravity so as to be used in gravity separation, solids as ores being placed in these liquids and used for sink-float separation therein.

| Fine Solid Particle | True Specific Gravity |
|---|---|
| Barytes ($BaSO_4$) | about 4.6 |
| Pyrite ($FeSO_4$) | about 4.6 |
| Magnetite sand ($Fe_3O_4$) | about 4.7 |
| Ferrosilicon (Fe + Si) | about 5.5 |

However, although the upper limit of the specific gravity of a liquid which can be formed by this method depends upon the specific gravity of the fine solid particles serving as a medium and the ratio of water mixed therewith, any increase in the ratio of the fine particles mixed with the water causes the viscosity of the liquid to be increased. Thus, precise sink-float separation even of particles having sizes of 5 to 6 mm is difficult, and in practice the upper limit of the ratio of the fine particles mixed with the water is 40% by volume. Therefore, the upper limit for the specific gravity of a gravity liquid which can be formed by a medium of the type that generally used is 2.6 to 2.8 at most, and it is difficult to form a liquid having a specific gravity higher than this limit and yet having a low viscosity.

The treatment of scrap of automobiles and domestic appliances has recently become an important social problem, and the separation and recovery of the aluminium contained in this scrap has become a particularly important social demand.

Among these items of scrap, the engine blocks of automobiles contain portions made of aluminum alloy having a specific gravity reaching 3.15, while the true specific gravity of pure aluminium itself is 2.6. Thus, the specific gravity liquid formed by using a medium of the type generally used is unsatisfactory as a specific gravity liquid for use in sink-float separation of aluminium alloy, and such a specific gravity liquid cannot be easily formed.

SUMMARY OF THE INVENTION

The present invention has been achieved with a view to solving the above-described problem, and it is an object of the present invention to provide a gravity separation method which uses iron powder and which is capable of precise sink-float separation of aluminium alloy or the like using a specific gravity liquid having high specific gravity and yet low viscosity.

To achieve the above-described object, a gravity separation method using iron powder of the present invention is characterized by mixing and suspending the iron powder composed of fine particles having a size of 40 microns or less in water to form a specific gravity liquid with a specific gravity of at least 2.6 up to 3.5 depending upon the intended use, and by pouring the various raw materials to be treated such as metals, ores and the like into the specific gravity liquid formed so that the raw materials are subjected to sink-float separation.

In the aforementioned gravity separation method, iron powder which is produced by steel works and which is composed of fine particles having a size of 40 microns or less is mixed and suspended in water contained in a water bath for the purpose of separating and recovering aluminum or an alloy thereof from scrap derived from automobiles, domestic appliances or the like, or an ore, to form a specific gravity liquid with, for example, a specific gravity of about 2.6 to be used for recovering aluminium or a specific gravity liquid with a specific gravity of 3.15 or more and low viscosity to be used for recovering aluminium alloy. The scrap of automobiles etc. or ore is poured into the specific gravity liquid formed so that the aluminium alloy with a specific gravity of about 3.15 or other non-ferrous metals with specific gravities lower than this value can be separated and recovered as floated product.

As described above, in the present invention, the iron powder composed of fine particles having a size of 40 microns or less is used to form a specific gravity liquid with a specific gravity of 2.6 or more, depending upon the intended use, and various raw materials such as metals or ores are poured into the specific gravity liquid formed so as to subject these raw materials to sink-float separation. Therefore, it is possible to highly precisely separate aluminium or an alloy thereof which has a higher specific gravity from the shredded scrap of automobiles or domestic appliances, and to separate out substances which cannot be generally separated by conventional methods. In addition, since the use of iron powder in forming a specific gravity liquid with low viscosity enables separation of particles having sizes down to about 3 mm which is smaller than that which is feasible with conventional methods, the invention offers the remarkable effect that sink-float separation can be effected precisely.

DETAILED DESCRIPTION OF THE PREFERRED EMBODIMENT

An example of the present invention uses an iron powder, which is composed of carbon steel and which has the following physical properties, as the medium for forming a liquid having a high specific gravity and low viscosity:

True specific gravity: 6.5 to 7.0

| | |
|---|---|
| True specific gravity: | 6.5 to 7.0 |
| Particle size: | +100 mesh . . . 10% or less<br>−325 mesh . . . 80 to 90% |
| Surface property: | The surfaces have films of iron oxide thereon so that no red rust occurs in water (for example, $Fe_3O_4$ film). |
| Magnetic property: | The iron powder has strong magnetism so as to be suitable for recovering them in the water. |

Content of non-magnetic substances 2% or less

Content of magnetic substances 98% or more

Settling property: The height of the clear water produced in 5 minutes is 10% or less of the height of a specific gravity liquid, and the settling speed of the iron powder in water is not so high.

Figure 1:
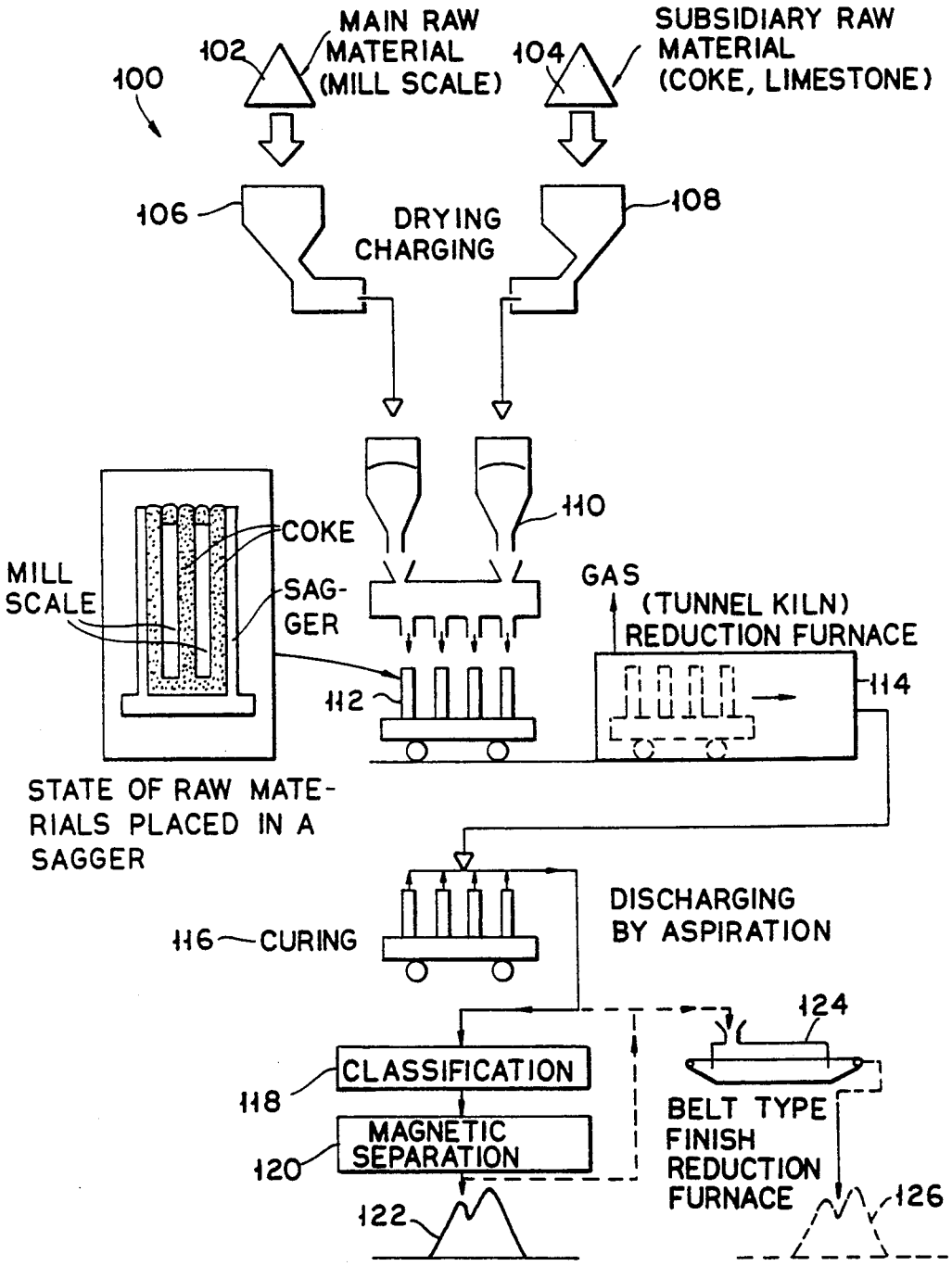
FIG. 1 shows the production process of a $Fe_3O_4$ coated steel powder.

FIG. 1 shows a production process for producing $Fe_3O_4$ coated steel powder. The main raw material used in this process is mill scale. The mill scale is provided at 102 in FIG. 1 and dried at 106. Coke powder, which serves as the reducing material is provided at 104 and dried at 108. The dried mill scale and coke is provided into an apparatus 110 which is used to load these materials into a sagger 112. The mill scale and coke powder are vertically arrange in layers and inserted into the sagger, as shown in the drawing. The sagger is placed in a tunnel kiln 114 having a reducing environment and a temperature of approximately 1000° C. The temperature of the tunnel kiln should be less than the melting point of the scale. The mill scale is reduced in the tunnel kiln in a few hours. The sagger is taken from the furnace after the reduction is complete at which time the temperature of the powder is approximately 800° C. The powder is cooled to a temperature of approximately 400° C. to 600° C. outside of the furnace at 116. Since the outside of the furnace is subjected to outside air, i.e. an oxidate environment, the surface of the iron powder is oxidized and a coating film of $Fe_3O_4$ is formed thereon. The powder is sequentially crushed and classified by blowing at 118 and separated magnetically at 120 to produce a high quality powder which can be utilized as a heavy liquid separating medium having optimum grain size and magnetic properties. The powder produced by the curing step can alternatively be passed through the belt-type finish reduction furnace 124 to produce a reduced iron powder at 126 which is suitable for powder metallurgy.

Figure 2:
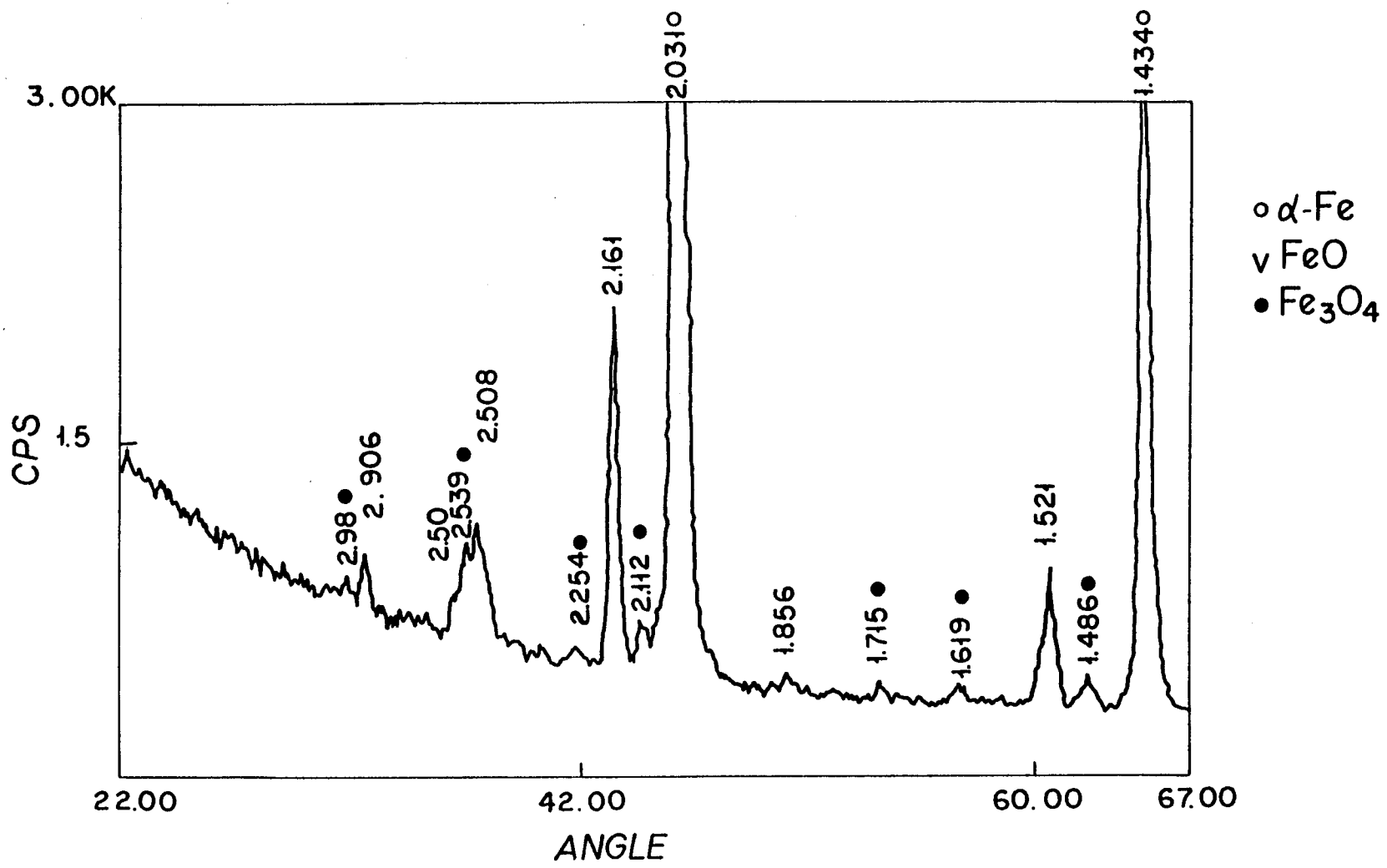
FIG. 2 shows an X-ray analysis of the powder produced by the process of FIG. 1.

FIG. 2 illustrates an X-ray analysis of the powder produced at 122. This X-ray analysis confirms this reoxidation.

A liquid with a high specific gravity of 2.6 or more is formed by using iron powder having such physical properties, depending upon the intended use. The formation of a liquid having a high specific gravity of 3.2 is described below. In this case, the ratio of the iron powder mixed with water is as follows:

| | Weight (Kg) | Volume ($m^3$) |
|---|---|---|
| Iron powder | 2600 | 0.40 |
| Water | 600 | 0.60 |
| Total | 3200 | 1.00 |

Concentration by volume = 40%
Concentration by weight = 83%

This specific gravity liquid has a concentration by volume of 40% and a sufficiently low viscosity, while a specific gravity as high as 3.2 can be obtained. Thus, the aluminium alloy contained in an engine block can be easily recovered by using a sink-float separation method. In addition, since the content of magnetic substances is as high as 98%, the iron powder can be recovered by means of a wet-type magnetic separator with substantially no loss if the product obtained by sink-float separation is washed with fresh water.

As described above, the iron powder liquid with high specific gravity has low viscosity and thus enables raw materials to rapidly settle or float and gravity separation can be achieved with little error occurring due to undesired movement of the materials.

When non-ferrous metal pieces obtained from shredded automobile scrap were subjected to gravity separation using the liquid with a high specific gravity of 3.2 having the above-described physical properties, the results obtained were as follows:

| | Example | Conventional Example |
|---|---|---|
| Float yield of recovered aluminium | 40% | 40% |
| Sink yield of non-ferrous metal alloy exclusive of aluminium | 60% | 60% |
| Aluminium recovery efficiency | 98% | 95% |
| Contents of impurities in recovered aluminium | 2.0% or less | 5% or more |

The precision of this separation is extremely high compared with conventional separation methods using other media and liquids with high specific gravities. The above-described aluminium recovery efficiency and contents of impurities in the recovered aluminium are much better than the above-described values for the Conventional Example which cannot be easily obtained by conventional methods. The value of recovered aluminium depends to a significant extent upon the amount of impurities contained therein, i.e., the purity of aluminium. The example of the present invention shows a reduction in the amount of impurities to a value one half or less that obtainable with conventional methods.

In addition, in the sink-float separation of the above-mentioned example using the high-specific gravity liquid composed of iron powder, the specific gravity liquid has low viscosity and thus enables gravity separation of fine particles and separation of particles having a size down to 3 mm with high precision. In contrast, the high-specific gravity liquid obtained from a medium (the above-described fine solid particles) which is generally used has high viscosity and thus makes precise sink-float separation even of particles having a size of 5 to 6 mm difficult.

Therefore, the separation method using the high-specific gravity liquid obtained from the above-described medium can be applied to almost all sink-float separators such as rotary drum-type, vertical wheel-type and screw sweeping-type separators regardless of the classes thereof. Although this example concerns a liquid with a specific gravity of 3.2, the use of iron powder having a true specific gravity of up to 7.0 is feasible and liquids having specific gravities within the range of 2.6 to 3.5 can be formed by changing the ratio of iron powder mixed in. Aluminium alloys as well as certain types of ore can be subjected to sink-float separation using a high-specific gravity liquid having a specific gravity of 3.5.

It is also effective to add fine particles (slime) of some clay minerals for the purpose of maintaining the stability of the above-described specific gravity liquid of iron powder.

Since there is no industrial example in which various raw materials are subjected to sink-float separation using the above-described specific gravity liquid obtained by using iron powder as a medium, this invention will allow the development of a new industrial field in which iron powder is used as a new heavy media material.

As described above, in the present invention, a liquid having a specific gravity of 2.6 or more is formed by using iron powder composed of fine particles having a size of 40 microns or less, depending upon the intended use, and various raw materials such as metals or ores are poured into the specific gravity liquid so as to be subjected to sink-float separation. Therefore, aluminium or an alloy thereof having a high specific gravity can be separated and concentrated with high precision from shredded automobile scrap or scrap derived from domestic appliances, and substances which cannot be separated by conventional methods can thus be separated. In addition, since the specific gravity liquid using iron powder has low viscosity, the present invention enables separation and concentration of fine particles having a size down to about 3 mm, which is smaller than what can be separated by conventional methods, and offers the excellent effect that precise sink-float separation is possible.

What is claimed is:

1. A gravity separation method using an iron composition powder comprising mixing and suspending said iron composition powder composed of fine particles having a size of 40 microns or less in water to form a liquid suspension having specific gravity within the range of 2.6 to 3.5, and pouring non ferrous metals or ores into said specific gravity liquid suspension so as to subject said nonferrous metals or ores to sink-float separation wherein said powder used for said specific gravity liquid has surfaces with oxide films composed of $Fe_3O_4$ and insides composed of carbon steel.

* * * * *